United States Patent [19]

Giannotti

[11] 4,037,428

[45] July 26, 1977

[54] BEVERAGE COOLER ASSEMBLY

[76] Inventor: Albert J. Giannotti, 800 Live Oak Ave., Menlo Park, Calif. 94025

[21] Appl. No.: 668,452

[22] Filed: Mar. 19, 1976

[51] Int. Cl.[2] ..... F25D 3/08

[52] U.S. Cl. ..... 62/371; 62/457; 62/530

[58] Field of Search ..... 62/529, 530, 457, 371, 62/430, 372

[56] References Cited

U.S. PATENT DOCUMENTS

| | | | |
|---|---|---|---|
| 627,231 | 6/1879 | Hinrichs | 62/530 |
| 662,541 | 11/1900 | Miskolczy | 62/530 |
| 1,595,385 | 8/1926 | Cusack | 62/372 |
| 2,504,911 | 4/1950 | Whitecar | 62/457 |
| 2,526,165 | 10/1950 | Smith | 62/530 |
| 3,089,317 | 5/1963 | Bufaline | 62/430 |
| 3,205,678 | 9/1965 | Stoner | 62/457 |
| 3,302,428 | 2/1967 | Stoner et al. | 62/371 |
| 3,360,957 | 1/1968 | Paquin | 62/457 |
| 3,434,302 | 3/1969 | Stoner et al. | 62/530 |
| 3,922,879 | 12/1975 | Arnold | 62/529 |

*Primary Examiner*—Lloyd L. King

[57] ABSTRACT

A beverage cooler assembly including a base and a hollow cylinder supported vertically from said base with a refrigerant container removably carried on said base within said cylinder. The hollow cylinder is adapted to receive a beverage container to cool the beverage.

9 Claims, 3 Drawing Figures

BEVERAGE COOLER ASSEMBLY

BACKGROUND OF THE INVENTION

This invention relates generally to a beverage cooler assembly.

Many wines and other beverages are preferably served cold. Prior to serving they are cooled to the correct temperature in suitable refrigerators. However, the entire content of the beverage container is not generally served at one time. In most instances the container is left on the table. Of course, the temperature of the container rises towards room temperature. In many of the better restaurants ice buckets are provided and the beverage container is placed in the ice to maintain its temperature. Such buckets are bulky, not convenient to store, and costly.

Improved container cooling devices have been proposed. U.S. Pat. No. 3,302,428 describes a device for keeping cool a can or bottle of beverage. The device comprises a double-walled container filled with a refrigerant liquid. A similar device is shown on U.S. Pat. No. 3,161,031. A bottle chilling assembly, particularly adapted for wine bottles, is shown in U.S. Pat. No. 3,434,302. The assembly holds a bottle vertically in close contact with removable refrigerant containing capsules. The assembly is rather complex.

OBJECTS AND SUMMARY OF THE INVENTION

It is a general object of the present invention to provide a simple, efficient beverage cooler assembly.

It is another object of the present invention to provide a cooler assembly in which the beverage container can be viewed.

It is another object of the present invention to provide an inexpensive, simple beverage cooler assembly.

The foregoing and other objects of the invention are achieved by a cooler assembly including a hollow cylinder adapted to receive and surround a beverage container, a base supporting said cylinder in a vertical position and a removable refrigerant container supported within the cylinder by the base and adapted to receive the bottom of the beverage container.

DESCRIPTION OF THE PREFERRED EMBODIMENT

Figure 1:
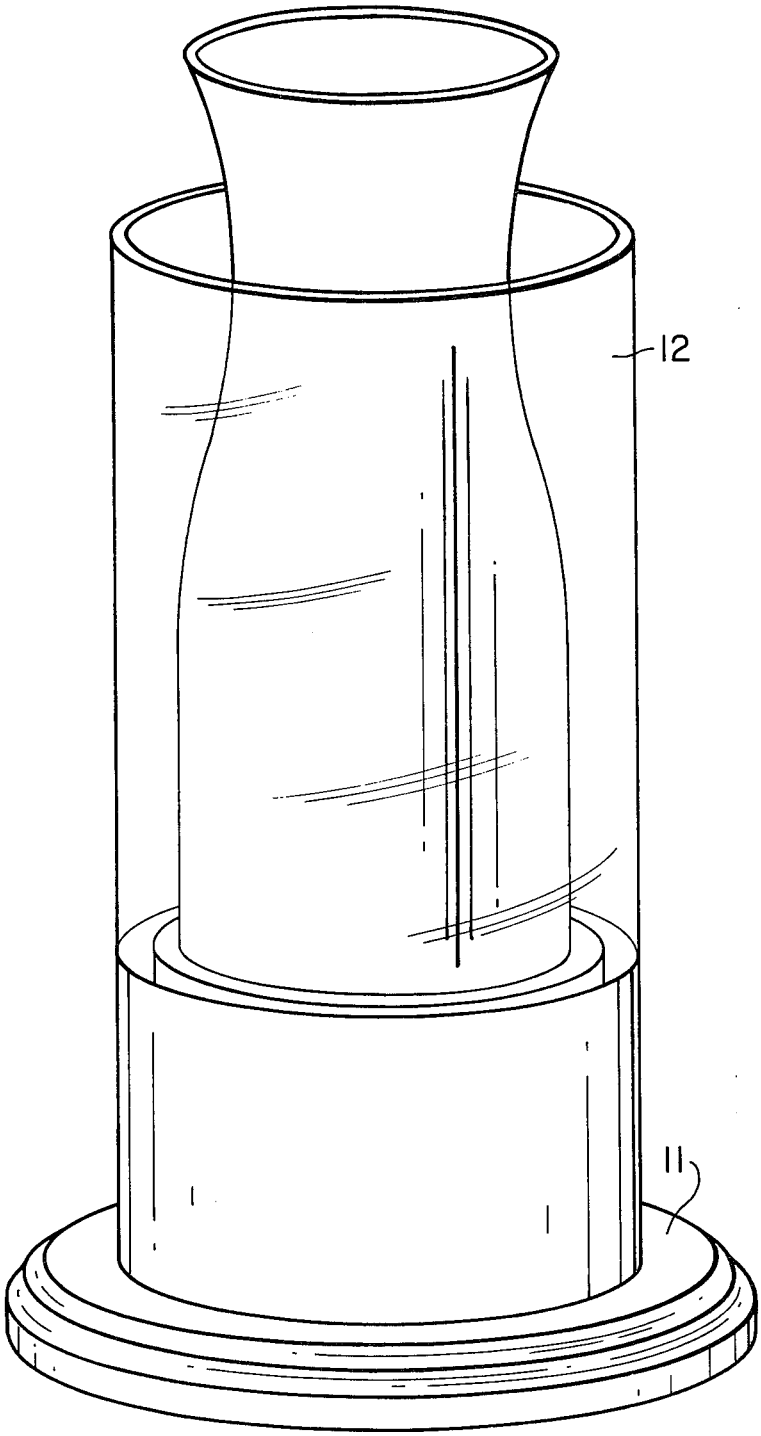
FIG. 1 is a perspective view of a beverage cooler assembly in accordance with the invention showing a beverage container disposed therein.
Figure 2:
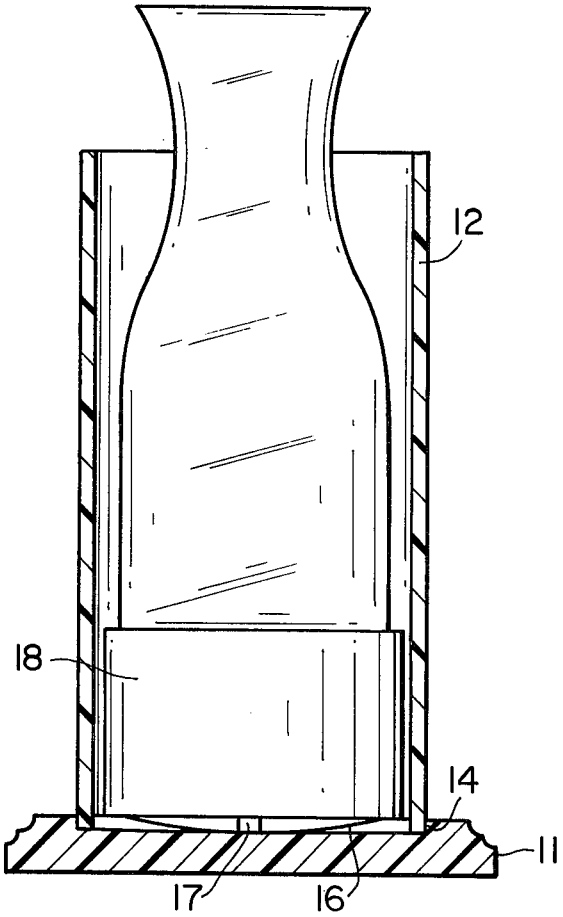
FIG. 2 is a sectional elevational view of the beverage cooler container shown in FIG. 1.
Figure 3:
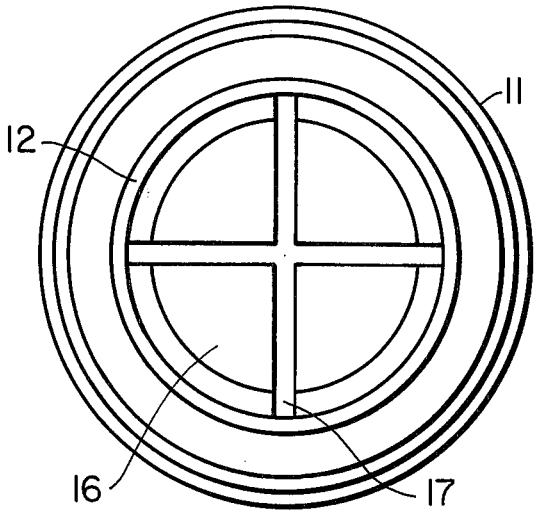
FIG. 3 is a top view of the container.

Referring to the figures, the beverage cooler assembly is seen to include a base 11 which supports a hollow cylinder 12. As shown, the cylinder 12 is a circular cylinder formed as a separate member and is inserted in a groove 14 formed in the base 11. It is apparent, however, that the cylinder and base can be formed as a single unit by a molding process. Preferably, the base has a larger diameter than the cylinder to provide a stable support. Although the base is shown as being circular, it can, of course, be rectangular or other desired configuration. Preferably, the upper surface of the base lying within the hollow cylinder is provided with a well or depression 16 adapted to receive any condensation from the beverage container or the refrigerant container to be presently described. The depression or well may include a plurality of radial slots 17 to permit the condensation to easily flow into the well.

Disposed within the cylinder and supported by the base is a cylindrical container 18 filled with a refrigerant. The refrigerant container serves to maintain the temperature of the beverage by conduction from the base of the beverage container and by convection from the sides. The refrigerant container is removable so that it can be in a refrigerator or suitable cooler to cool the refrigerant to a low temperature whereby, when the container is placed at the bottom of the cylinder, it cools the beverage by conduction and the interior of the cylinder by convection. Since cold air is heavier than warm air, the refrigerated or cooled air remains within the cylinder and surrounding the beverage container. Preferably, the container is filled with a water solution of glycerine or any other well known cooling solution which freezes at temperatures well below the freezing point of water.

Referring again to FIG 1, the bottom portion of the hollow cylinder 12 may be opaque whereby to mask from view the refrigerant container 18. The opaque portion may consist of a band of material suitably secured to the cylinder, a painted band or a silk screened coating. The band may also be made by roughing the walls of the cylinder. The band may carry advertising material or a label. Preferably, the upper part of the cylinder is transparent or translucent whereby the beverage container placed within the cylinder can be viewed. Thus, the type and brand of wine or other beverage being served can be directly viewed through the cylinder. On the other hand, in certain applications it may be preferable to make the entire cylinder opaque and carry advertising material on the walls of the cylinder.

In the drawings the container is seen to be a so called carafe. Of course, wine bottles of various sizes can be accommodated. A cylinder can be made of smaller diameter and shorter to maintain cans of beer or other canned beverages cool for prolonged periods of time.

In one particular instance a wine cooler was constructed for a one-quart carafe and included a plexiglass base and a plexiglass cylinder having an internal diameter of 4¼ inches. A refrigerant container of diameter 3 15/16 inches and height 2⅜ inches was filled with coolant and cooled in a refrigerator to a temperature of 0° F. The refrigerant container was then placed in the cylinder and a one-quart carafe of white wine at a temperature of 40° F. was placed in the cylinder and supported on the refrigerant container. The surrounding room temperature was 70° F. The temperature of the wine placed in the cooler varied as follows:

| Time | Wine Temperature |
|---|---|
| 0:0° | 40° |
| 0:15 | 40⅛° |
| 0:32 | 42° |
| 0:47 | 43° |
| 1:02 | 44° |
| 1:17 | 44⅛° |
| 1:32 | 44½° |

Under the same conditions with the carafe exposed to room temperature, the temperature of the wine varied as follows:

| | |
|---|---|
| 1:15 – 0:00 | 40° |
| 1:30 – 0:15 | 44° |
| 1:47 – 0:32 | 47° |
| 2:02 – 0:47 | 50° |
| 2:17 – 1:02 | 52° |
| 2:32 – 1:17 | 53° |
| 2:47 – 1:32 | 56° |

Thus it is seen that the simple, inexpensive cooler of the present invention provided excellent maintenance of the beverage temperature. The cooler is inexpensive, simple in construction, and efficient.

What is claimed is:

1. A beverage cooler assembly comprising a hollow cylinder adapted to receive and surround a beverage container, a base supporting said cylinder in a vertical position, a removable refrigerant container filled with a refrigerant supported by the base within the cylinder, said refrigerant container having flat parallel upper and lower surfaces and side surfaces which have the same shapes as the hollow cylinder and sized to fit closely adjacent to the inner surface thereof, the upper surface of said container receiving and supporting the beverage container disposed in the hollow cylinder in heat transfer relationship therewith to cool the bottom of the beverage container by conductive cooling and the sides by convective cooling, said removable refrigerant container being removable from the cylinder for recooling and reusing.

2. A beverage cooler as in claim 1 wherein said hollow cylinder is a circular cylinder.

3. A beverage cooler as in claim 1 wherein said refrigerant container is cylindrical to fit within said hollow cylinder with its walls closely adjacent the walls of the hollow cylinder.

4. A beverage cooler as in claim 1 wherein the portion of the base within said cylinder includes means for collecting condensation.

5. A beverage cooler as in claim 3 wherein opaque means are provided on said hollow cylinder adjacent said refrigerant container.

6. A beverage cooler as in claim 1 wherein said hollow cylinder is transparent.

7. A beverage cooler as in claim 1 in which said hollow cylinder is translucent.

8. A beverage cooler as in claim 1 wherein said hollow cylinder and said base are formed in one piece.

9. a beverage cooler as in claim 1 wherein said base includes a groove adapted to receive and accommodate the adjacent end of the hollow cylinder and means are provided for securing the same together.

* * * * *